US006479779B1

(12) United States Patent
Falkingham et al.

(10) Patent No.: US 6,479,779 B1
(45) Date of Patent: Nov. 12, 2002

(54) VACUUM SWITCHING DEVICE

(75) Inventors: Leslie Falkingham, Rugby (GB); Rama Parashar, Rugby (GB)

(73) Assignee: Alstom UK Limited, Rugby (GB)

( * ) Notice: Subject to any disclaimer, the term of this patent is extended or adjusted under 35 U.S.C. 154(b) by 0 days.

(21) Appl. No.: 09/890,493

(22) PCT Filed: Feb. 1, 2000

(86) PCT No.: PCT/GB00/00290

§ 371 (c)(1),
(2), (4) Date: Oct. 5, 2001

(87) PCT Pub. No.: WO00/46826

PCT Pub. Date: Aug. 10, 2000

(30) Foreign Application Priority Data

Feb. 2, 1999 (GB) ..... 9902140

(51) Int. Cl.[7] ..... H01H 33/66
(52) U.S. Cl. ..... 218/128; 218/123; 218/154
(58) Field of Search ..... 218/123–129, 218/78, 84, 120, 140, 154

(56) References Cited

U.S. PATENT DOCUMENTS 4,704,506 A 11/1987 Kurosawa et al.
4,760,223 A * 7/1988 Suzuki ..... 218/123
4,982,059 A * 1/1991 Bestel ..... 218/128
5,099,093 A * 3/1992 Schels et al. ..... 218/128
6,072,141 A * 6/2000 Slamecka ..... 218/123

FOREIGN PATENT DOCUMENTS

DE 36 10241 A1 10/1987
DE 43 29 518 A1 1/1994

* cited by examiner

*Primary Examiner*—Elvin Enad
*Assistant Examiner*—M. Fishman
(74) *Attorney, Agent, or Firm*—Kirschstein, et al.

(57) ABSTRACT

A vacuum switching device comprising an evacuated envelope including an insulating cylinder, a stationary contact electrode and a movable contact electrode housed within the envelope. The electrodes are adapted to be engaged or disengaged to close or open a circuit in which the device is connected. At least one of the electrodes comprises a coil which, in use, is adapted to generate magnetic fields to control the formation of arcs when the electrodes are disengaged, each electrode having an end face adapted to contact the other electrode when in the engaged condition. At least one of the electrodes has a low resistance electrical path transverse to the axis of the electrode in a region of the end face.

25 Claims, 3 Drawing Sheets

VACUUM SWITCHING DEVICE

BACKGROUND OF THE INVENTION

This invention relates to improvements in vacuum switching devices, for example vacuum interrupters, or vacuum switches.

Vacuum switching devices, adapted to switch large currents have been known for many years. Various designs of electrode, which are engaged or disengaged to switch the current, have been proposed. Examples of various electrode designs can be seen in EP 0349303, DE 3915519 and DE 3610241.

However, known switching devices are not necessarily as convenient to fabricate and effective at dissipating arcs when the electrodes are disengaged as may be desired.

SUMMARY OF THE INVENTION

According to the invention in a vacuum switching device comprising an evacuated envelope including an insulating cylinder, a stationary contact electrode and a movable contact electrode housed within the envelope which are adapted to be engaged or disengaged to close or open a circuit in which the interrupter is connected and at least one of the electrodes comprising a coil defining means which, in use, is adapted to generate magnetic fields to control the formation of arcs when the electrodes are disengaged, each electrode having an end face adapted to contact the other electrode when in the engaged condition, at least one of the electrodes has a low resistance electrical path transverse to the axis of the electrode in a region of the end face.

A device according to the invention should allow better diffusion of the arc, resulting in interruption of higher currents for a particular size of switching device; the device should become more efficient. Indeed, the increase in efficiency is greater than was expected from theoretical models.

As the skilled person will appreciate known switching devices have current paths transverse to the axis of the electrode in a region of the end face. However, such known devices do not have a low resistance current path. The current path in prior art devices offers a high electrical resistance, but since this was the only path through which the electrical current could flow it was not thought of importance,. that it had a high resistance.

Where used herein the term "low resistance" is intended to be construed as meaning path capable of better supporting an arc at a centre region of the end face compared with prior art electrodes and perhaps may mean substantially the same resistivity as standard electrical conductors, such as copper, silver, etc. In prior art devices the current path was provided from materials such as CuCr, WC—Ag or WCu mixes which have a higher resistivity than copper or silver. An alternative definition of low resistance may be to have a resistivity of substantially 40 nΩm or below taken at 20° C. Alternatively the resistivity may be substantially 30 nΩm or below, or indeed substantially 20 or 15 nΩm or below (all taken at 20° C.).

The low resistance current path may be provided by a plate of low resistance material mounted in a region of the end face. The plate may or may not be planar. The plate may be mounted on a tubular member also part of the electrode.

In an alternative embodiment the low resistance current path may be provided by a base of a cup. It will be appreciated that the walls of the cup provide the same function as the tubular member upon which a plate is mounted. For the remainder of this specification the term tubular member should be interpreted to mean the walls of a cup as well as a tubular member. Also, where the term plate is used this should be interpreted to mean the base region of a cup, or a separate plate.

Both of the plate and cup embodiments provide a simple and convenient structure for forming an electrode.

Conveniently slits are provided in the tubular member, defining current paths within the tubular member. There may be between two and thirty slits provided around the circumference of the tubular member, and these are preferably equispaced.

The coil defining means may be provided by the slits in the tubular member.

Preferably, the slits extend over substantially the whole length of the tubular member. This provides good control of the magnetic field generated by current flowing through the switching device. The slits may stop short of an end wall at an end region of the tubular member opposite the end face. In an alternative embodiment the slits may extend into the end wall at an end region of the tubular member opposite the end face.

The plate may contain a recess. A contact member adapted to contact a similar member on the other electrode may be provided, possibly within the recess. An advantage of the contact member is that it can be fabricated from a material having more suitable properties than the low resistance material of the plate. The contact member may be fabricated from a copper chromium Cu—Cr mixture, perhaps a tungsten carbide silver mixture (WC—Ag) or perhaps a tungsten copper (WCu) mixture. The skilled person will appreciate that other materials will be suitable, and that the choice of material for the contact member is largely influenced by the way in which it affects the arc formed during opening of the switching device; different metals give off different vapours providing different ions for the arc.

The slits on the tubular member may continue onto the low resistance electrical path in the region of the end face. An advantage of continuing the slits in such a manner is that eddy currents within the region of the end face can be controlled and their disadvantageous effects reduced.

The skilled person will appreciate that there is a large design freedom in the design of slits in the low resistance electrical path so that the field generated by current flowing through this path can be controlled in a number of ways. The slits in the low resistance electrical path may be designed to assist in the interruption of current whereby current is caused to flow substantially in the same direction through the low resistance electrical path as within the tubular member. Alternatively the slits in the low resistance electrical path may be directed such that current is caused to flow substantially in the opposite direction to the current flowing in the tubular portion.

The direction of current flow within the low resistance current path effects the nature of the magnetic field formed by current flowing through the coil defining means. The formation of eddy currents within the low resistance current path is undesirable because components of the eddy currents may produce a magnetic field of a direction opposite from that desired and will therefore degrade the performance of the device. It is therefore desirable to reduce the formation of eddy currents.

Slits in the plate may or may not extend into any recess formed therein.

The electrodes may be supported by conducing members, adapted to connect the circuit in which the device is connected to the electrodes.

Preferably a spacer member is provided between the low resistance electrical path and the conducting member. Preferably at least a portion of said spacer member is fabricated from a material which provides a high resistance current path. The spacer member may be fabricated from substantially entirely a material providing a high electrical resistance. A high electrical resistance is required to ensure that there is no low resistance current path between the end face and the conductive member apart from through the tubular portion (it is noted that insulation could be provided in addition to the spacer or that the spacer may be made from insulating materials, or a portion of the spacer made from insulating materials). An advantage of the spacer member is that the mechanical strength of the contact electrodes is increased; presence of the slits in the end face, and tubular member reduces the mechanical strength and this may need compensation.

The spacer member may be tubular, may be tubular with at least one end face thereon (i.e. a cup arrangement), or may be a rod and disc arrangement, or may be solid.

The spacer member may be brazed in position or may be welded in position. Thus, the mechanical strength of the contact electrode may be further increased.

The spacer may be fabricated from any of the following materials (although of course this list is not intended to be exhaustive): stainless steel, refractory material, ceramic, or any other composite material having a relatively high electrical resistivity.

The spacer may have a resistivity of over substantially 100 nΩm at 20° C.

The tubular member and plate may be a single component fabricated from one piece of material. The tubular member may be attached to the conducting member by brazing. However, the skilled person will appreciate that any other means may be used which attaches the tubular member to the conducting member.

In an alternative embodiment the plate may be a separate component attached to the tubular member. Of course, any suitable method may be used to attach the end face to the tubular member, although brazing may be preferred.

The plate may be fabricated from copper or copper alloy. Also, the tubular member may be fabricated from copper or copper alloy. Any copper used may be oxygen free high conductivity copper (OFHC copper).

A hole may be provided at a centre region of the plate, providing for easier manufacture of the plate and/or the cup. For instance the hole may allow the cup to be held in a machine whilst the plate or cup are processed.

The hole may be substantially 10% of the diameter of the plate. (Although other diameters are possible and perhaps any of the following diameters may be suitable: 20%, 30%, 40%, 50%, 50%).

Further, a hole may be provided at a centre region of the contact member, which may have the dimensions discussed in r elation to the hole in the plate and offer similar advantages.

The contact member may be of larger diameter than the tubular portion. Alternatively the contact member may be of substantially the same diameter as the tubular portion, or may be of smaller diameter.

BRIEF DESCRIPTION OF THE DRAWINGS

There now follows by way of example only a description of the invention with reference to the accompanying drawings of which.

DETAILED DESCRIPTION OF THE PREFERRED EMBODIMENT

Figure 1:
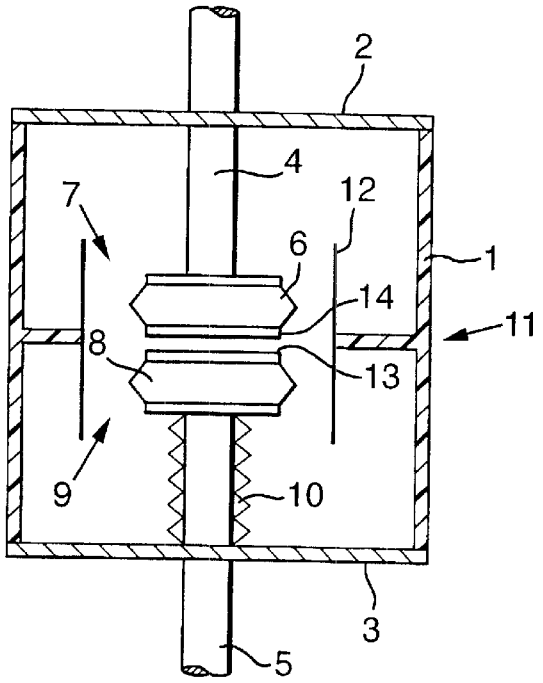
Fig.1. (Prior Art)
FIG. 1 shows a schematic section through a vacuum switching device.

A typical arrangement for a vacuum interrupter is. shown in FIG. 1 wherein an evacuated envelope 11 comprising an insulating cylinder 1, with metallic end plates 2, 3 joined on opposite ends of the insulating cylinder 1. Within the cylinder 1 there is provided a stationary contact 7 and a movable contact 9. Each of the contacts 7, 9 has an electrode means at an end portion comprising a coil forming means 6, 8 and a contact member 13, 14.

Figure 2:
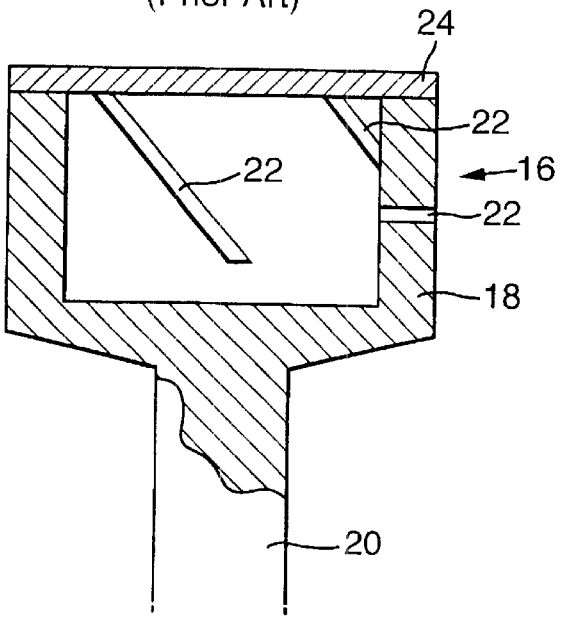
Fig.2. (Prior Art)
FIG. 2 shows a schematic partial section through an electrode of the prior art.

FIG. 2 shows an electrode 16 according to the prior art wherein a coil forming means 18 is integrally formed onto an end portion of a conducting member 20. The coil forming means 18 comprises a slotted cup shape wherein the open end portion of the cup is opposite the conducting member 20. Slots 22 are provided within the walls of the cup. A contact member 24 is provided on the open end portion of the cup (at an end face of the electrode) and is adapted to contact a similar member on the other contact. The contact member 24 is fabricated from CuCr and thus provides a high resistance electrical current path.

Figure 3:
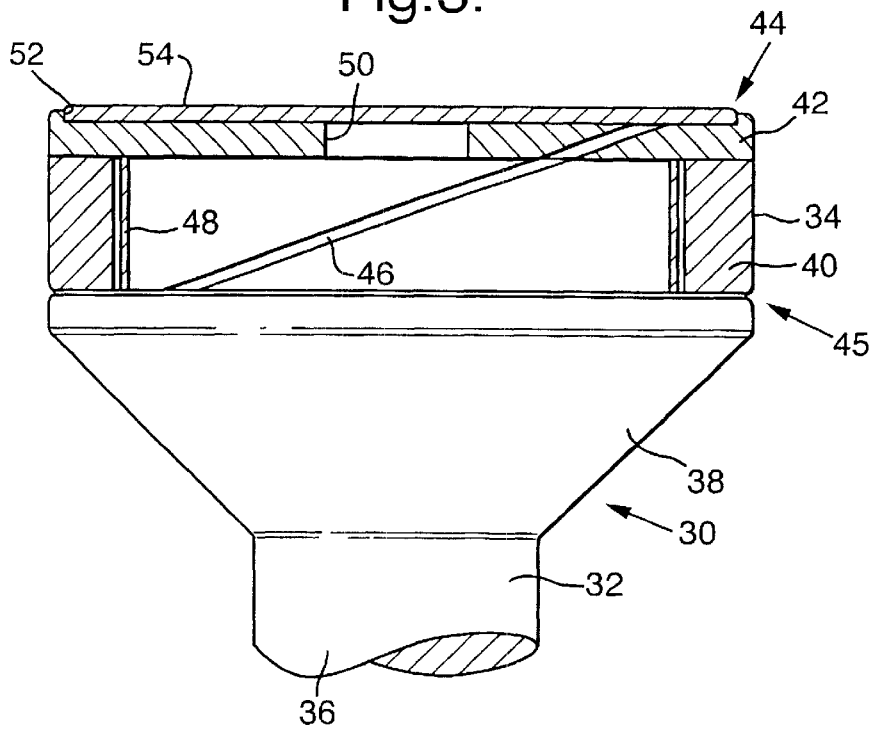
FIG. 3 shows a partial section through an electrode according to the present invention.

FIG. 3 shows an electrode 30 according to the invention wherein a conducting member 32 supports a tubular member 34. The conducting member 32 comprises a rod portion 36 and an expanded portion 38 which has a diameter increasing from the diameter of the rod portion 36 to that of the tubular member 34. The rod portion 36 and the expanded portion 38 may be fabricated from the same piece of material.

The tubular member 34 comprises a cylindrical tubular portion 40 with a plate 42 at a first end 44 thereof. At its second end 45, the tubular member 40 is attached to the expanded portion 38 of the conducting member 32, in this example by brazing.

In the tubular portion 40 and plate 42 there are provided a number of slits 46, although in FIG. 3 only one such slit can be seen. The slits 46 pass through the wall of both the tubular portion 40 and the plate 42.

A spacer 48 comprising a cylindrical tube is positioned co-axially inside the tubular member 34. The length of the spacer 48 is such that it contacts both the expanded portion 38 and the plate 42 and therefore provides mechanical support for the plate 42 and tubular member 34. The spacer 48 is in this example brazed in position to the expanded portion 38 and is fabricated from a stainless steel thus ensuring that it does not provide a low resistance electrical path between the expanded portion 38 and the plate 42. Although current can flow through the spacer the majority flows through the low resistance path through the tubular member 34.

The plate 42 has formed therein at a central portion a hole 50 which facilitates the manufacturing process for the plate, or plate and tubular member combination. Also within the plate 42 is a recess 52 which receives a contact member 54 of complementary dimensions. The contact member 54 is fabricated from CuCr which provides a vapour with suitable properties for the formation of an arc on opening the contacts. The contact member 54 is in intimate contact with the plate 42 across at least 50% of the area. Although in this embodiment the contact member is of smaller cross-section than the electrode, in other embodiments it may be of greater or substantially the same cross-section as the electrode.

Figures 4A, 4B, 4C:
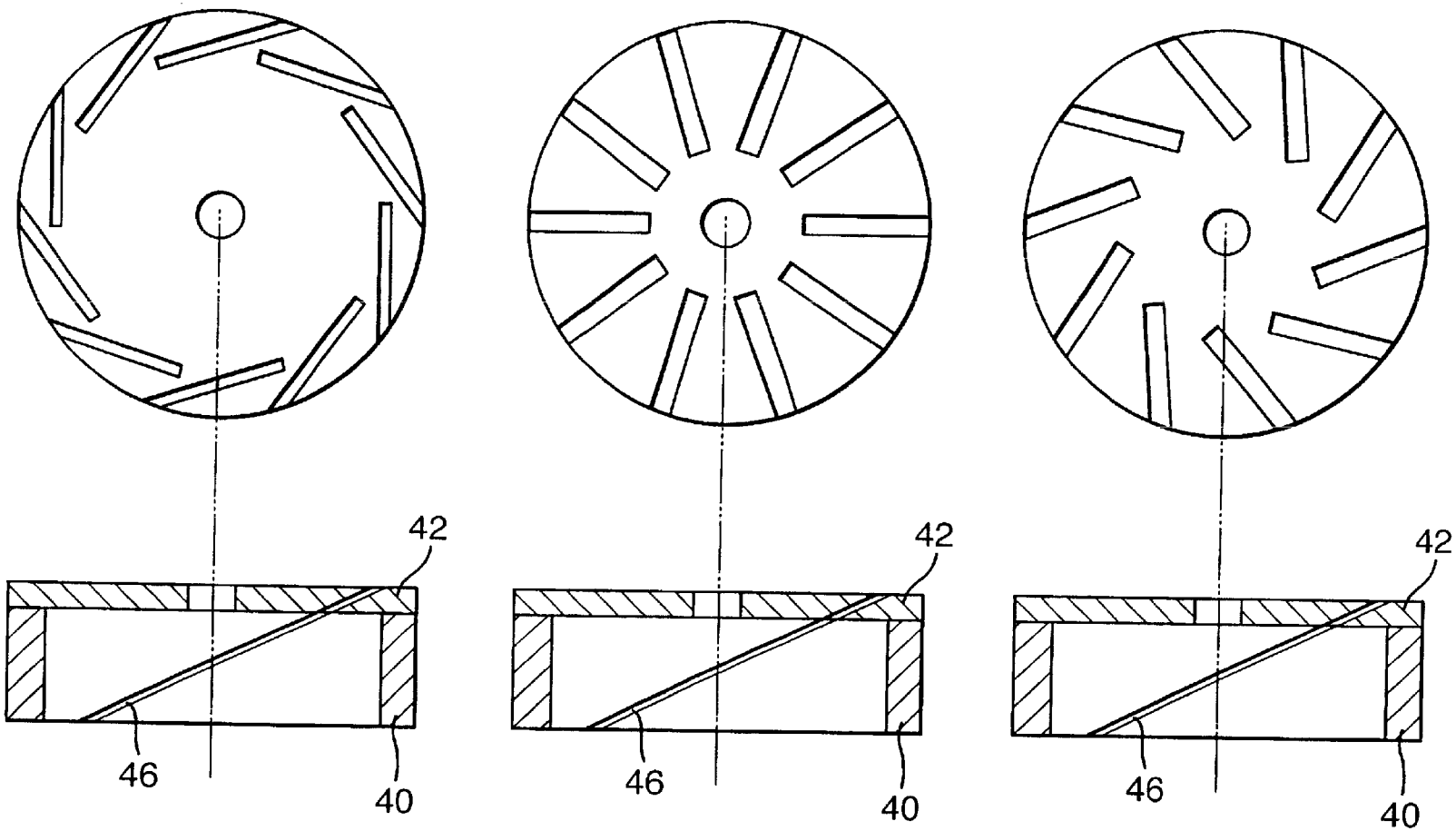
FIGS. 4*a* to *c* shows various arrangements of the electrode shown in FIG. 3.

As can be seen in FIG. 4 the slits 46 in the tubular member 34 are continued into the plate 42. However, as shown in FIGS. 4*a* to *c* the direction of the slits 46 in the plate 42 can be varied to alter the properties of the axial magnetic field generated by current flowing through the tubular member 34 and plate 42.

In FIG. 4*a* the slits in plate 42 are shown in a first direction wherein current in the plate 42 is caused to flow generally in the same sense as in the tubular member 34. In FIG. 4*b* the slits in the plate 42 are radial, whereas in FIG. 4*c* the slits are shown in a second direction wherein current in the plate 42 is caused to flow in generally the opposite sense to that flowing in the tubular member 34. The slits in the plate 42 also help to prevent eddy currents flowing in the plate 42, which can reduce the desired magnetic field.

In use, the stationary 7 and moveable 9 contact of FIG. 1 would be provided with an arrangement such as shown in FIG. 3. When current was flowing through the interrupter the contact members 54 of both contacts would be engaged. When it was desired to interrupt the current flow the moveable contact 9 is drawn away from the stationary contact 7, and an arc therefore formed. To support the arc current flows through the conducting member 32, through the tubular member 34, through the plate 42 into the contact member 54 and through this path in reverse in the other electrode.

As the current flows through the tubular member 34, it is forced by the slits 46 to flow in a spiral, thus effectively flowing through a coil. This spiralling current flow generates a magnetic field which tends to diffuse the arc, thus spreading the arc's energy over the surface of the contact member 54 preventing overheating. The advantage of the low resistance current path (through the plate 42) is that current can flow across the end face region to feed the arc toward the centre region of the contact member 54. This geometry provides reduced contact resistance and therefore, less energy is dissipated while the device is in service in a closed position.

The resultant distribution of magnetic flux density is optimised across the whole contact member and it means that more current is carried through the arc from the centre region of the contact member 54 than with prior art designs.

The design provides increased short circuit current interrupting capacity.

Figure 5:
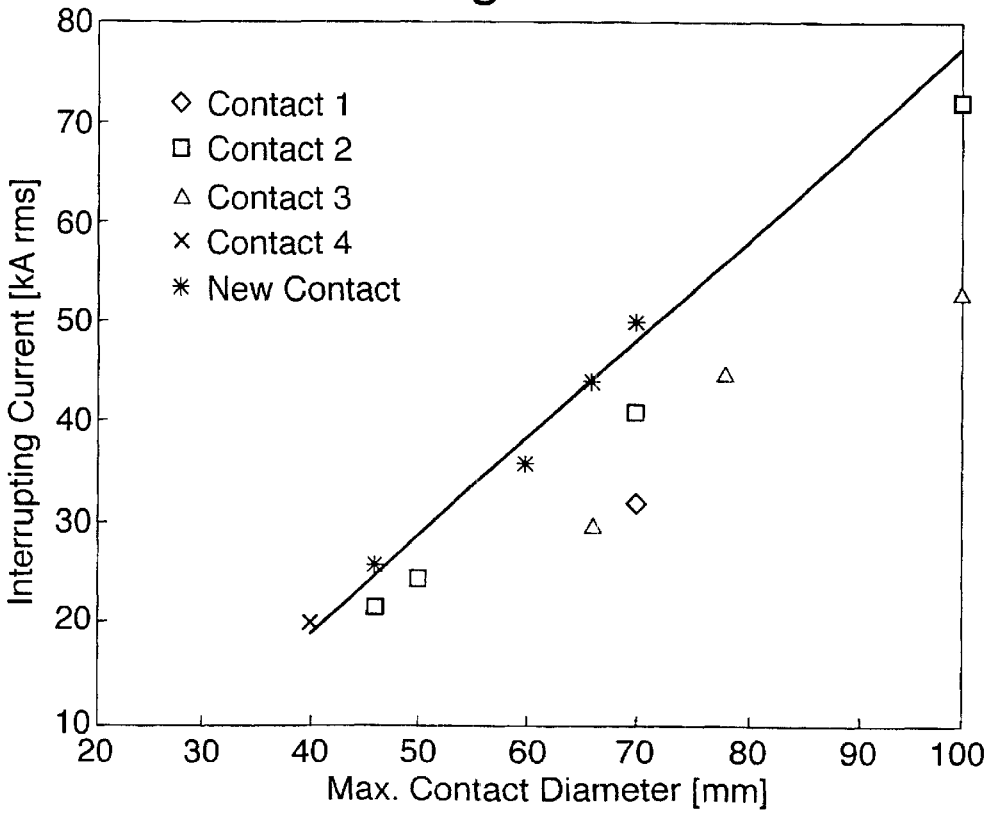
FIG. 5 shows interrupting capability of an interrupter according to the present invention compared to prior art interrupters.

FIG. 5 shows the interrupting performance of the interrupter compared to four known axial magnetic field contact geometries which have been established by testing. Contact 2 corresponds to a slotted cup design substantially as shown in FIG. 2 and DE 36 10 241. Contacts 3 and 4 correspond to coil contacts (in particular contact 3 is a four segment coil contact).

In prior art interrupters, such as shown in FIG. 2, current could only flow across the end face region through the contact member 24. Since the contact member offered a relatively high resistance current path an arc toward the centre region of the electrode was not fed with current as well as in a device according to the present invention. Thus in the prior art the arc may not have defused as well as in the device according to the present invention.

Further, the provision of slits in the plate 42 has the advantage that the formed magnetic field can be tailored as desired.

The design of the slits can be tailored to give the desired performance of the interrupter. However, there would generally be between 3 and 35 slits around the circumference of the tubular member 34. These slits may be angled substantially in the range 5° to 40° from the horizontal. Of course, angles such as 10°, 20°, 30° would all be possible.

What is claimed is:

1. A vacuum switching device, comprising: a stationary contact electrode and a movable contact electrode, the electrodes being engaged or disengaged to close or open a circuit in which the device is connected, the electrodes being housed in an evacuated insulating envelope of cylindrical form, at least one of the electrodes comprising a coil defining means for generating magnetic fields to control arcing when the electrodes are disengaged while current is flowing through the electrodes, each electrode having a contact member for contacting the other electrode, the contact member being provided on an end face of the electrode, each contact member having an electrical resistance, and a member of lower electrical resistance than the resistance of the contact member interposed between at least one of the contact members and the coil defining means to provide a low resistance electrical path extending underneath the contact member, the low resistance electrical path being effective to cause the current to flow from the coil defining means into the member of lower electrical resistance from a peripheral region thereof towards an inner region thereof to feed the arcing towards a center region of the contact member.

2. The device according to claim 1, wherein the coil defining means is operative for generating axial magnetic fields.

3. The device according to claim 1, wherein at least one of the electrodes comprises a tubular wall member, and wherein the contact member which confronts the other electrode spans an end of the tubular wall member, and wherein the member of lower electrical resistance than the resistance of the contact member is interposed between the contact member and the tubular wall member to provide the low resistance electrical path between the tubular wall member and the contact member.

4. The device according to claim 3, wherein the low resistance electrical path is provided by a plate in an end region of the electrode.

5. The device according to claim 4, wherein the plate is mounted upon the tubular wall member.

6. The device according to claim 4, wherein the plate comprises a base of a cup-shaped member whose walls form the tubular wall member.

7. The device according to claim 1, wherein the low resistance electrical path is provided by a material having a resistivity of under 40 nΩm at 20° C.

8. The device according to claim 1, wherein the low resistance electrical path is provided by a material having a resistivity of under 25 nΩm at 20° C.

9. The device according to claim 1, wherein the low resistance electrical path is provided by a material having a resistivity of under 15 nΩm at 20° C.

10. The device according to claim 3, wherein the tubular wall member has slits that constitute the coil defining means.

11. The device according to claim 10, wherein the slits in the tubular wall member extend over a whole length of the tubular wall member.

12. The device according to claim 10, wherein the slits in the tubular wall member continue from the tubular wall member into the low resistance electrical path.

13. The device according to claim 3, wherein the contact member is provided within a recess of complementary size within an end face.

14. The device according to claim 12, wherein the slits in the low resistance electrical path are operative for controlling the formation of a magnetic field.

15. The device according to claim 14, wherein the slits in the low resistance electrical path are operative for causing the current to flow in the low resistance electrical path in generally the same direction as in the tubular wall member.

16. The device according to claim 14, wherein the slits in the low resistance electrical path are operative for causing the current to flow in the low resistance electrical path in generally the opposite direction as in the tubular wall member.

17. The device according to claim 1, wherein a spacer member is provided to support the low resistance electrical path.

18. The device according to claim 17, wherein the spacer is provided between the low resistance electrical path and a conducting member for connecting the circuit in which the device is connected to the electrodes.

19. The device according to claim 18, wherein the spacer member is fabricated from a material with a high electrical resistivity.

20. The device according to claim 18, wherein the spacer member is fabricated from stainless steel.

21. The device according to claim 18, wherein the spacer member comprises a tubular member.

22. The device according to claim 4, wherein a hole is provided at a center region of the plate.

23. The device according to claim 22, wherein the hole provided in the plate is on the order of 10% of a diameter of the plate.

24. The device according to claim 1, wherein the contact member has a hole at a center region.

25. The device according to claim 24, wherein the hole provided in the contact member is on the order of 10% of a diameter of the contact member.

* * * * *

UNITED STATES PATENT AND TRADEMARK OFFICE

CERTIFICATE OF CORRECTION

PATENT NO. : 6,479,779 B1
DATED : December 10, 2002
INVENTOR(S) : Michael J. Bryant It is certified that error appears in the above-identified patent and that said Letters Patent is hereby corrected as shown below:

Column 1,
Line 38, “form” should be -- from --.

Signed and Sealed this

Fifteenth Day of April, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,479,779 B1
DATED : November 12, 2002
INVENTOR(S) : Leslie Falkingham et al.

It is certified that error appears in the above-identified patent and that said Letters Patent is hereby corrected as shown below:

This certificate supersedes Certificate of Correction issued April 15, 2003, the number was erroneously mentioned and should be vacated since no Certificate of Correction was granted.

Signed and Sealed this

First Day of June, 2004

JON W. DUDAS
*Acting Director of the United States Patent and Trademark Office*